US005484064A

United States Patent [19]

Melichar

[11] Patent Number: 5,484,064

[45] Date of Patent: Jan. 16, 1996

[54] DOCUMENT HOLDER

[76] Inventor: Paul R. Melichar, 727 Longwood Dr., Lake Forest, Ill. 60045

[21] Appl. No.: 189,094

[22] Filed: Jan. 31, 1994

[51] Int. Cl.[6] ..... A47F 5/00

[52] U.S. Cl. ..... 211/50; 206/449

[58] Field of Search ..... 211/50, 45; 221/33, 221/63; 206/425, 449, 451, 555

[56] References Cited

U.S. PATENT DOCUMENTS

| | | | |
|---|---|---|---|
| 374,509 | 12/1887 | Thum | 211/50 |
| 812,634 | 2/1906 | Brown | 211/50 |
| 1,070,169 | 8/1913 | Ott | 211/50 |
| 1,533,880 | 4/1925 | Malwitz . | |
| 2,294,144 | 8/1942 | Weidner | 211/13 |
| 2,732,935 | 1/1956 | Gui | 206/449 |
| 3,023,929 | 3/1962 | Stein | 248/300 |
| 3,198,341 | 8/1965 | Sasaki | 211/50 |
| 3,365,067 | 1/1968 | Miller et al. | 211/45 |
| 3,878,966 | 4/1975 | Haboush | 221/33 |
| 4,585,128 | 4/1986 | Hannecke | 211/51 |
| 4,609,112 | 9/1986 | Belanger et al. | 211/45 |
| 4,860,904 | 8/1989 | Williams | 211/50 |
| 4,938,365 | 7/1990 | Conway et al. | 211/50 |
| 5,094,349 | 3/1992 | DeVito | 211/50 |

*Primary Examiner*—Robert W. Gibson, Jr.
*Attorney, Agent, or Firm*—Lockwood, Alex, Fitzgibbon & Cummings

[57] ABSTRACT

A vertical document holder for use in displaying and dispensing flexible paper documents includes a compartment having left and right sidewalls, a bottom and an open top for receiving a stack of documents. The bottom of the compartment rises toward the front of the compartment to provide vertical separation between the exposed top edges of the documents, and the spacing between the sidewalls of the compartment is progressively decreased toward the front of the compartment to provide a spacing between the center portions of the exposed edges as the documents progressively bow toward the open end.

10 Claims, 3 Drawing Sheets

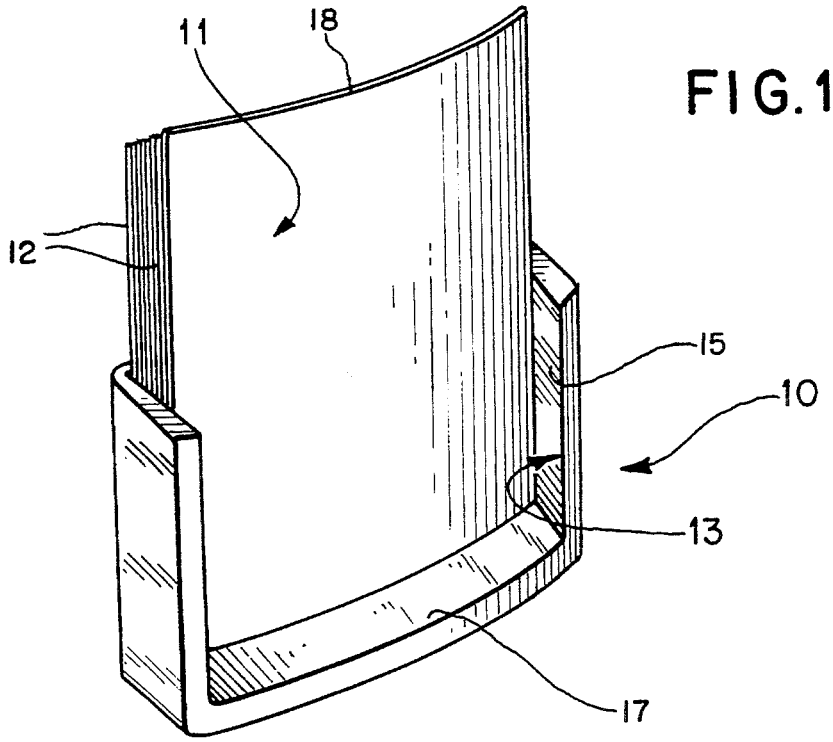
FIG.1
FIG. 2
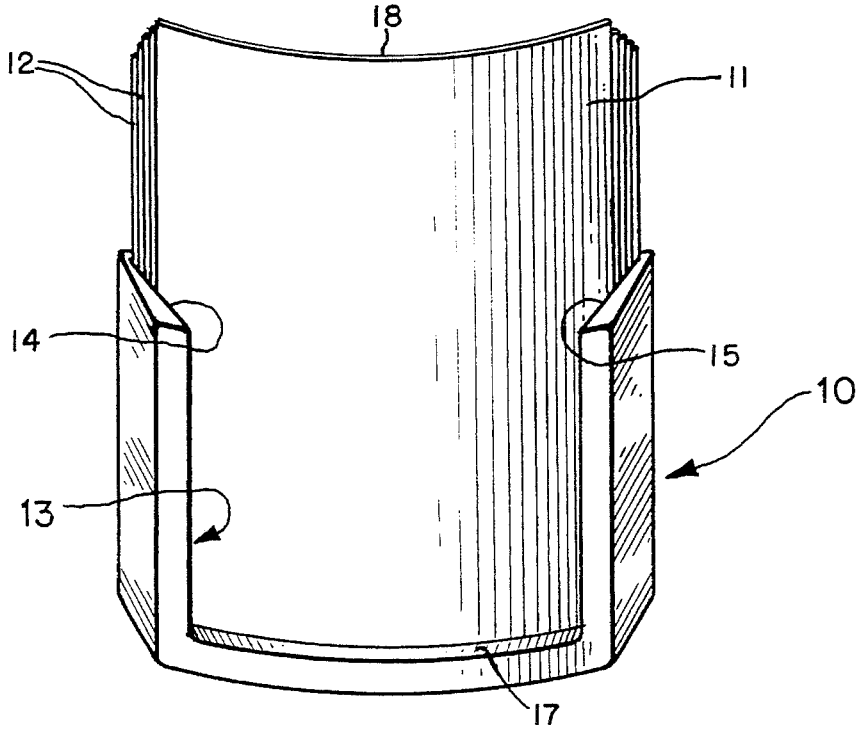

FIG. 3
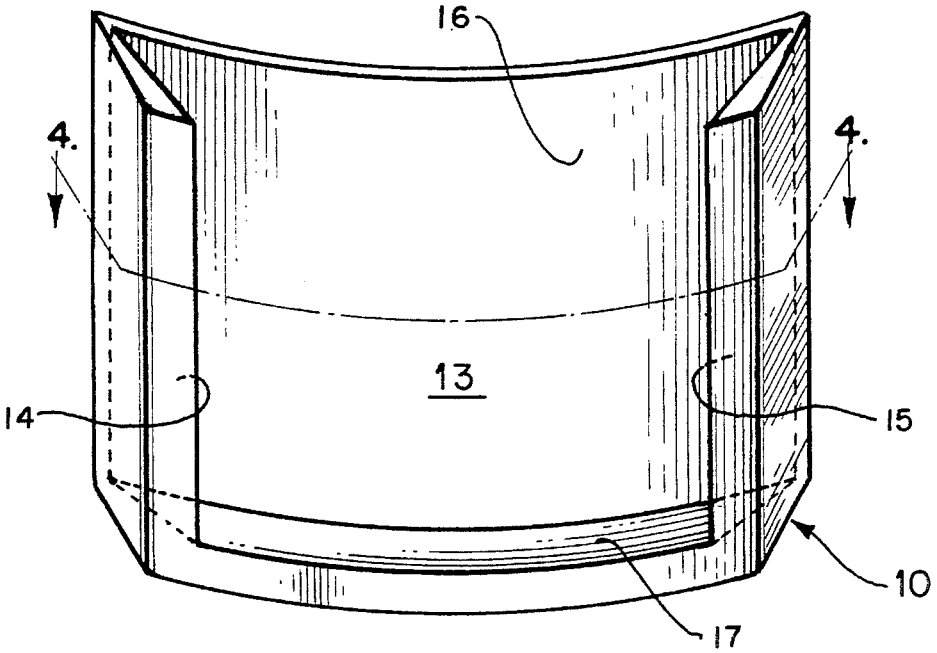
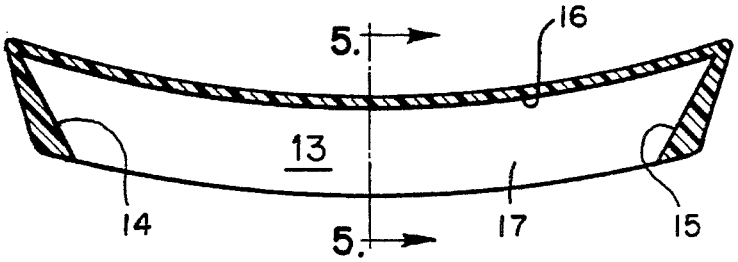
FIG. 4
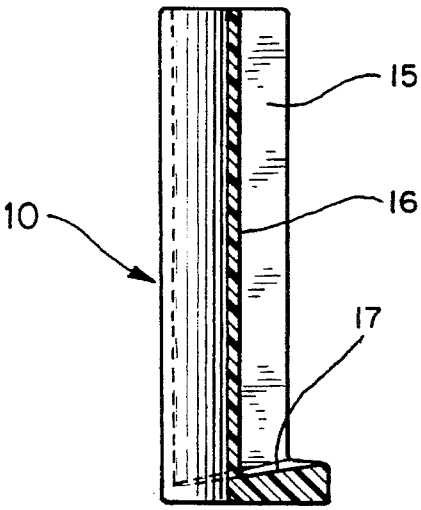
FIG. 5

DOCUMENT HOLDER

BACKGROUND OF THE INVENTION

The present invention relates generally to vertical document holders and more particularly to an improved document holder wherein individual documents can be easily removed from a stack of displayed documents.

Vertical document display holders are widely used to display and dispense promotional handouts, advertisements, circulars, newsletters, pamphlets, and the like. Typically, such holders contain a stack of the displayed documents, with the front most document prominently displayed to passers-by in a manner which invites attention to and removal of the document. Typically, the holder is attached to a wall or supported on a flat tabletop. Examples of prior designs for such paper holders are found in U.S. Pat. Nos. 5,094,349, 4,938,365, 4,860,904 and 1,533,880.

Unfortunately, with prior paper holder designs it has been difficult to remove a single document from the stack, either because the documents bend or sag within the holder, or because the documents are too closely spaced together. This has resulted in passers-by either undesirably not stopping to take a document, or unintentionally removing multiple copies from the holder when only a single document is desired.

Accordingly, it is general object of the invention to provide a new and improved vertical document holder. appended claims. The invention, together with the further objects and advantages thereof, may best be understood by reference to the following description taken in conjunction with the accompanying drawings, in the several figures of which like reference numerals identify like elements, and in which:

FIG. 1 is a perspective view of a vertical document holder constructed in accordance with the invention.

FIG. 2 is a front elevational view of the document holder of FIG. 1 showing a stack of documents displayed and presented therein.

FIG. 3 is a front elevational view of the document holder of FIG. 1 without documents and showing the construction of the document compartment defined therein.

FIG. 4 is a cross-sectional view of the document holder taken along line 4—4 of FIG. 3.

FIG. 5 is a cross-sectional view of the document holder taken along line 5—5 of FIG. 4.

FIG. 6 is a side elevational view of the document holder of FIGS. 1 and 2 partly in section to show the positioning of multiple documents therein.

FIG. 7 is a cross-sectional view of the document holder and documents of FIG. 6 taken along lines 7—7 of FIG. 6.

DESCRIPTION OF THE PREFERRED EMBODIMENT

It is a more specific object of the present invention to provide a new and improved vertical document holder wherein documents are supported and spaced for easy viewing and removal.

It is a still more specific object of the present invention to provide a new and improved vertical document holder wherein exposed edges of a stack of documents are presented with vertical and horizontal spacing to facilitate removal of a single document.

SUMMARY OF THE INVENTION

The invention is directed to a document holder for dispensing one at a time a plurality of flexible paper documents of a predetermined uniform width and height. The holder comprises means defining an open-topped compartment having left and right sidewalls, a backwall and a bottom, the left and right sidewalls having a minimum spacing less than the predetermined width of the flexible documents whereby the documents are bowed toward the front of the compartment when stacked therein, and the bottom rising as it extends from the backwall towards the open end whereby the exposed top edges of the front-most one of the flexible documents stacked within the compartment is vertically separated from the succeeding exposed top edge to facilitate removal of the front-most document from the stack.

BRIEF DESCRIPTION OF THE DRAWINGS

The features of the present invention which are believed to be novel are set forth with particularity in the Referring to the Figures, and particularly to FIGS. 1 and 2, a document holder 10 constructed in accordance with the invention is shown in conjunction with a stack 11 of documents 12 arranged for display and dispensing within the holder. In particular, the documents 12 are seen to be presented generally vertically for ready viewing by a passer-by, and to be vertically and horizontally spaced along their exposed top edges for convenient removal from the stack. The holder 10, which may be formed from either a hard plastic or metallic material, is seen to include a compartment 13 within which the individual documents are received.

Referring to FIG. 3, compartment 13 includes a left sidewall 14, a right sidewall 15, a rear wall 16, and a bottom 17. The top end of housing 13 is open such that the stack 11 of document 12 extends above the housing with the exposed edges 18 thereof providing a convenient means for grasping individual documents. The opposite edges 19 (FIG. 6) of the documents engage the bottom 17 of compartment 13.

Figure 7:
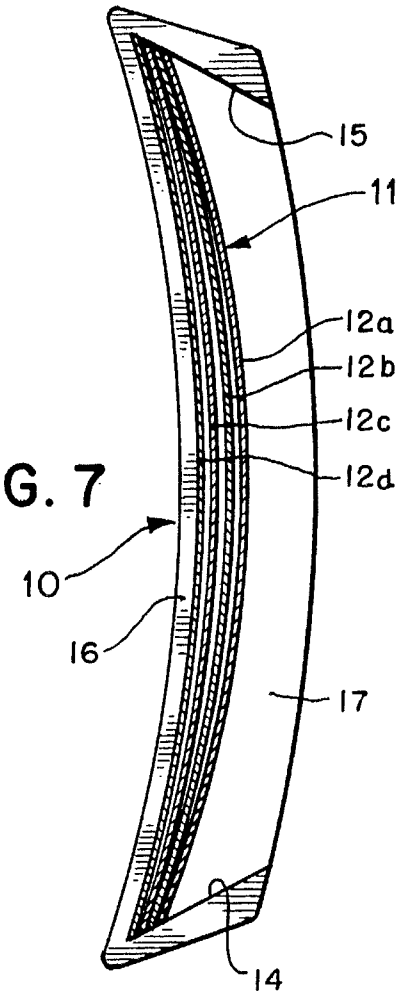

As best seen in FIGS. 3 and 4 the sidewalls 14 and 15 of compartment 13 are not parallel. Instead, extending from the rear wall 16, the spacing between the sidewalls decreases toward the front of the compartment. The initial spacing between the sidewalls at back wall 16 is purposely less than the width of the documents received within the compartment. This causes the documents to bow, as shown in FIG. 7. Since the spacing between the sidewalls decreases toward the front of the compartment, the documents 12 in the compartment become progressively more bowed toward the front of the compartment. In particular, in FIG. 7 the front-most document 12*a* is seen to be more bowed than the next succeeding document 12*b*. Similarly, document 12*b* is more bowed than the next succeeding document 12*c*. For optimum support of the document stack, and to prevent the documents from bowing in the reverse direction, rear wall 16 is seen to have an inward bow generally conforming to the bow of the least-bowed document 12*d*.

The bowing of documents 12 causes the documents to stand upright as they extend above compartment 13 and to be less susceptible to folding over. Also, the progressive bowing provided by the invention separates the center portions of the document edges, thereby making them easier to remove from the compartment.

Figure 6:
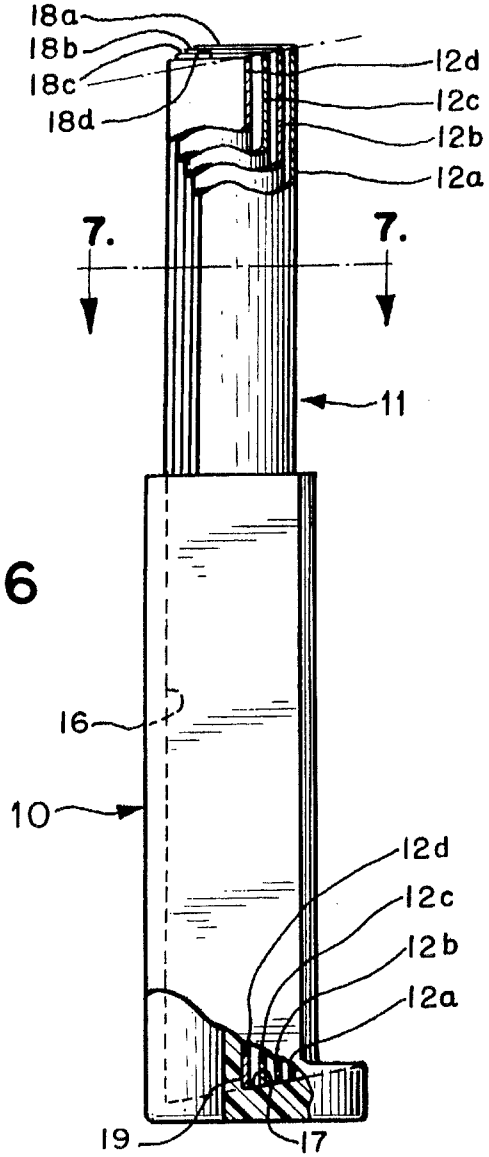

Referring again to FIGS. 3–6, the bottom of compartment 13 is seen to comprise a generally flat surface which ramps up toward the front of the compartment. As best shown in FIGS. 5 and 6, this causes the exposed top edge 18*a* of the front-most document 12*a* to be higher than the exposed top edge 18*b* of the next succeeding document 12*b* in document stack 11. Similarly, the exposed edge 18*b* of document 12*b* is higher than the exposed edge 18*c* of document 12*c*. The result is that each succeeding exposed document edge is slightly raised relative to the preceding document edge, with the front-most document edge being the most accessible to someone removing a document from the holder. This fact, coupled with the horizontal separation brought about by the progressive bowing of the center portions of the documents illustrated in FIG. 7, results in the document holder of the invention providing greatly improved accessibility to a single displayed document.

It will appreciated that document holder 10 can be dimensioned to accommodate a wide variety of document sizes. Furthermore, the degree to which the sidewalls 14 and 15 are inwardly angled, and the degree to which the bottom is upwardly angled, can be varied for optimum separation of various types of documents according to document quantity, thickness and stiffness.

The document holder may include a wider base for resting on a flat surface, or a plurality of mounting holes through which screws may extend to engage a wall surface in the event of wall mounting. Alternatively, the holder may be dimensioned to fit within an existing paper holder.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. A document holder for dispensing one at a time a plurality of flexible paper documents of a predetermined uniform width and length, said document holder comprising:

means defining an open-topped compartment having left and right sidewalls, a backwall and a bottom for receiving a stack of the documents with the top edges thereof projecting form the compartment;

said left and right sidewall having a spacing less then the predetermined width of the flexible documents whereby said documents are bowed toward the front of said compartment when stacked therein; and said bottom rising as it extends from said backwall towards said open end whereby the exposed top edge of the front-most one of said flexible documents stacked within said compartment is vertically seperate from the exposed top edge of the next succeeding exposed top edge of said stacked documents to facilitate the removal of said front-most documents from said stack.

2. A document holder as defined in claim 1 wherein said backwall is bowed inwardly into said compartment to conform generally to the bow of the rear-most one of said stacked documents therein.

3. A document holder as defined in claim 1 wherein said bottom comprises a generally flat surface progressively increasing in height as it extends from said backwall to said open front of said compartment.

4. A document holder as defined in claim 1 wherein the spacing between said sidewalls is progressively reduced toward the front of said compartment to provide a spacing between adjacent ones of said stacked documents at the center portions of said exposed top edges.

5. A document holder for dispensing one at a time a plurality of flexible paper documents of a predetermined uniform width and height, said holder comprising:

means defining an open-topped compartment having left and right sidewalls, a backwall and a bottom for receiving a stack of the documents with the top edge thereof projecting above the compartment;

said left and right sidewalls having a spacing less than the predetermined width of the flexible documents hereby said documents are bowed toward the front of said compartment when stacked therein, and said back wall being bowed inwardly to said compartment to conform generally to the rear-most one of said bowed documents; and said bottom comprising a generally flat surface extending from a lower level at the back of said compartment to a higher level at the front of said compartment whereby the exposed top edge of the front-most one of said flexible documents stacked within said compartment is vertically separated from the next succeeding exposed top edge of said stacked documents to facilitate the removal of said front-most document from said stack.

6. A document holder as defined in claim 5 wherein the spacing between said sidewalls is progressively reduced toward the front of said compartment to provide a spacing between adjacent ones of said stacked documents at the center portions of said exposed top edges.

7. A document holder for dispensing one at a time a plurality of flexible paper documents of a predetermined uniform width and height, said holder comprising:

means defining an open-topped compartment having left and right sidewalls, a backwall and a bottom for receiving a stack of the document with top edges thereof projecting from the compartment;

said left and right sidewalls having a spacing which is less than the predetermined width of the flexible documents and which is progressively reduced toward the front of the said compartment whereby said documents are bowed toward the front of said compartment and spaced at center portions of said projecting edges when stacked therein.

8. A document holder as defined in claim 7 wherein said backwall is bowed inwardly into said compartment to conform generally to the bow of the rear-most one of said stacked documents therein.

9. A document holder as defined in claim 7 wherein said bottom rises as it extends from said backwall towards said open end whereby the exposed top edge of the front-most one of said flexible documents stacked within said compartment is vertically separated from the exposed top edge of the next succeeding exposed top edge of said stacked documents to facilitate the removal of said front-most document from said stack.

10. A document holder as defined in claim 9 wherein said bottom comprises a generally flat surface progressively increasing in height as it extends from said backwall of said compartment.

* * * * *